US006905443B1

(12) United States Patent
Lo

(10) Patent No.: US 6,905,443 B1
(45) Date of Patent: Jun. 14, 2005

(54) GRADIENT ADJUSTING STRUCTURE OF A TREADMILL

(75) Inventor: Pai Hua Lo, Taichung Hsien (TW)

(73) Assignee: Alilife Industrial Co., Ltd., Taichung (TW)

( * ) Notice: Subject to any disclaimer, the term of this patent is extended or adjusted under 35 U.S.C. 154(b) by 283 days.

(21) Appl. No.: 10/370,501

(22) Filed: Feb. 24, 2003

(51) Int. Cl.[7] ..... A63B 22/02
(52) U.S. Cl. ..... 482/54
(58) Field of Search ..... 482/51–54

(56) References Cited

U.S. PATENT DOCUMENTS 6,676,572 B2 * 1/2004 Wang et al. ..... 482/54
6,726,602 B2 * 4/2004 Chang ..... 482/54

OTHER PUBLICATIONS

Pan et al., Adjusting device for a Tread Board of a Treadmill, Dec. 25, 2003, see Figs. 1, 3 & 4.*
Chen, Treadbase Supporting Structure for a Treadmill, Jul. 8, 2004, see Fig. 4.*
Chen, Lifting Mechanism and Treadmill Arrangement, Jul. 8, 2004, see Figs. 2–5.*

* cited by examiner

*Primary Examiner*—Justine R. Yu
*Assistant Examiner*—Tam Nguyen
(74) *Attorney, Agent, or Firm*—Rosenberg, Klein & Lee

(57) ABSTRACT

A gradient adjusting structure of a treadmill includes two symmetrical adjusting members and a telescopic rod. The center of the adjusting member is pivotally connected with inner face of the column near bottom end thereof. The first ends of the adjusting members are respectively pivotally connected with two sides of front end of the tread platform. A transverse beam is fixed between the second ends of the adjusting members and positioned under the bottom of front end of the tread platform, whereby the stop block of the tread platform can abut against the transverse beam. One end of the telescopic rod is pivotally connected with one side of the transverse beam, while the other end of the telescopic rod is pivotally connected with the bottom of the tread platform.

6 Claims, 10 Drawing Sheets

GRADIENT ADJUSTING STRUCTURE OF A TREADMILL

BACKGROUND OF THE INVENTION

The present invention is related to a gradient adjusting structure of treadmill, which is able to stably support the treadmill.

A conventional treadmill is generally equipped with a gradient adjusting structure for changing the slope of the tread platform and enhancing exercising effect. FIG. 9 shows an adjustment device for adjusting the height of the frame of the conventional treadmill. The adjustment device includes two linking plates 7 each of which is formed with a frame pivot hole 71, a front support lever pivot hole 72 and a long shaft pivot hole 73. The frame pivot hole 71 and the front support lever pivot hole 72 are respectively positioned at front end and the middle of the linking plate 7 in higher positions. The long shaft pivot hole 73 is positioned at rear end of the linking plate 7 in a lower position. Via the frame pivot holes 71, the linking plates 7 are respectively pivotally disposed on two sides of front end of the tread frame 6. Via the front support lever pivot holes 72, the linking plates 7 are pivotally connected with the front support lever 5. Then, a long shaft rod 731 is passed through the long shaft pivot holes 73 of the linking plates 7. Finally, an adjustment mechanism 8 is pivotally disposed on the long shaft rod 731. The operating end of the adjustment mechanism 8 transversely extends out to the tread frame 6 and is located on the locating plate 51 of the front support lever 5. Accordingly, by means of the operating member of the adjustment mechanism 8, when the drag worm 81 is displaced forward or rearward, the long shaft rod 731 is synchronously moved. At this time, the linking plates 7 will swing about the front support lever pivot hole 72, whereby the height of the position of the flame pivot hole 71 is adjusted to change the support angle of the tread frame 6 so as to ascend/descend the tread frame 6.

The tread frame 6 is pivotally connected with the front support lever 5 via the two linking plates 7. The drag worm 81 of the adjustment mechanism 8 is extended/retracted to ascend/descend the tread frame 6. Accordingly, the weight loaded on the tread frame 6 and the tread force are borne by the linking plates 7. The force exerted onto the linking plates 7 is applied to the drag worm 81 of the adjustment mechanism 8. When the tread frame 6 is descended to a lowest position, the drag worm 81 is extended to a longest extent. Under such circumstance, a bending stress is applied to the drag worm 81 to wear the worm 81. A sleeve 82 is fitted on the drag worm 81 between two locating plates 51 to buffer the force applied to the drag worm 81. However, this is not so helpful to the drag worm 81 with respect to bending stress and even the sleeve 82 will interfere with the rotation of the drag worm 81.

Furthermore, the tread frame 6 is ascended/descended with the front support lever pivot holes 72 of the linking plates 7 serving as the axis. In order to lift the front end of the tread frame 6 to a certain height, the distance between the front support lever pivot hole 72 and the frame pivot hole 71 must have a certain length. Accordingly, the force arm h1 between the front support lever pivot hole 72 and the frame pivot hole 71 of the linking plate 7 will be excessively long. When the tread frame 6 is upward pivotally folded about the frame pivot hole 71, as shown in FIG. 10, the overlong force arm h1 will increase the force applied to the front support lever pivot hole 72 of the linking plate 7. Therefore, after folded, the tread frame 6 has poor support strength and can be hardly stably supported.

SUMMARY OF THE INVENTION

It is therefore a primary object of the present invention to provide a gradient adjusting structure of a treadmill including a base seat and a tread platform mounted between two columns of the base seat. The bottom of front end of the tread platform has at least one stop block. The gradient adjusting device has two symmetrical adjusting members and a telescopic rod. Each adjusting member has a first and a second ends containing a certain angle and outward extending. The center of the adjusting member is pivotally connected with inner face of the column near bottom end thereof. The first ends of the adjusting members are respectively pivotally connected with two sides of front end of the tread platform. A transverse beam is fixed between the second ends of the adjusting members and positioned under the bottom of front end of the tread platform, whereby the stop block of the tread platform can abut against the transverse beam. One end of the telescopic rod is pivotally connected with one side of the transverse beam, while the other end of the telescopic rod is pivotally connected with the bottom of the tread platform. When the tread platform is lowered to the bottom, the stop blocks of the bottom of front end of the tread platform will abut against the transverse beam of the adjusting members so as to support the tread platform. Accordingly, the weight loaded on the tread platform and the tread force are shared by the transverse beam with the tread platform. Also, the bending stress exerted onto the telescopic rod is minimized to prevent the telescopic rod from being worn.

It is a further object of the present invention to provide the above gradient adjusting structure of the treadmill in which when the rear end of the tread platform is upward folded about the pivot sections between the adjusting members and the columns of the base seat, the first ends of the adjusting members pivotally connected with the tread platform are upward swung along with the tread platform. Accordingly, the force arm between the pivot sections of the adjusting members pivotally connecting with the columns and the tread platform is shortened. Therefore, the folded tread platform can be stably supported.

The present invention call be best understood through the following description and accompanying drawings wherein:

DETAILED DESCRIPTION OF THE PREFERRED EMBODIMENTS

Figure 1:
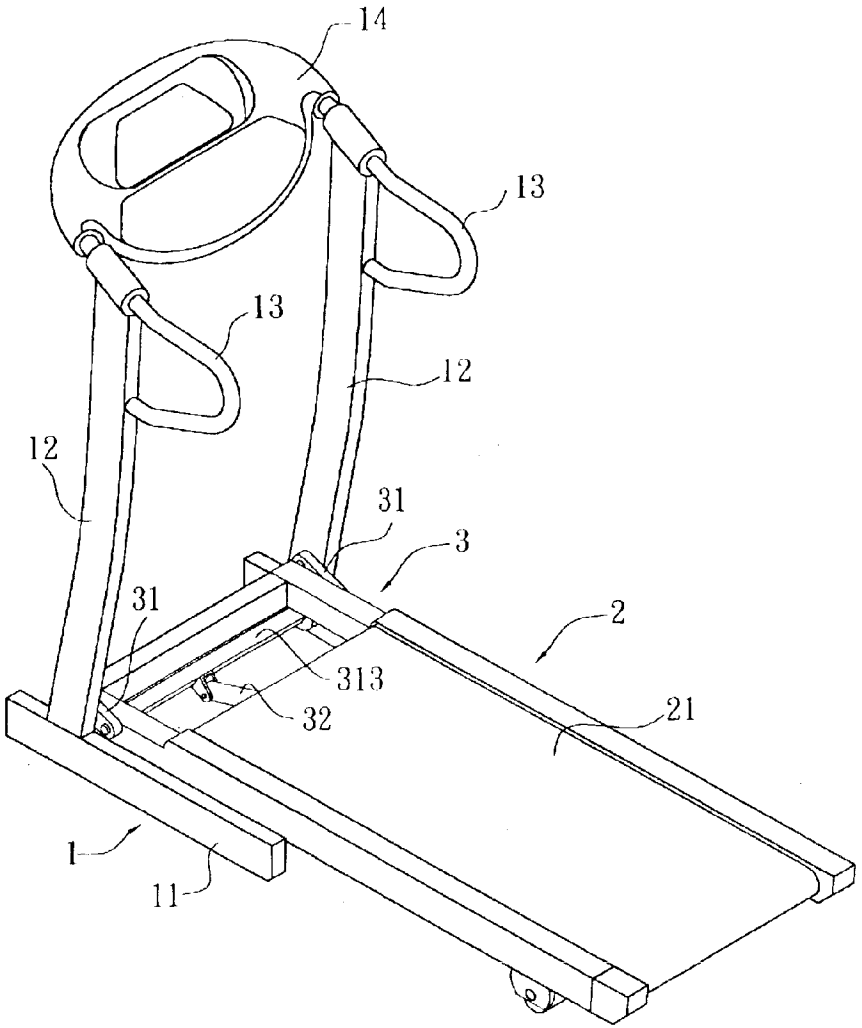
FIG. 1 is a perspective assembled view of the present invention.
Figure 2:
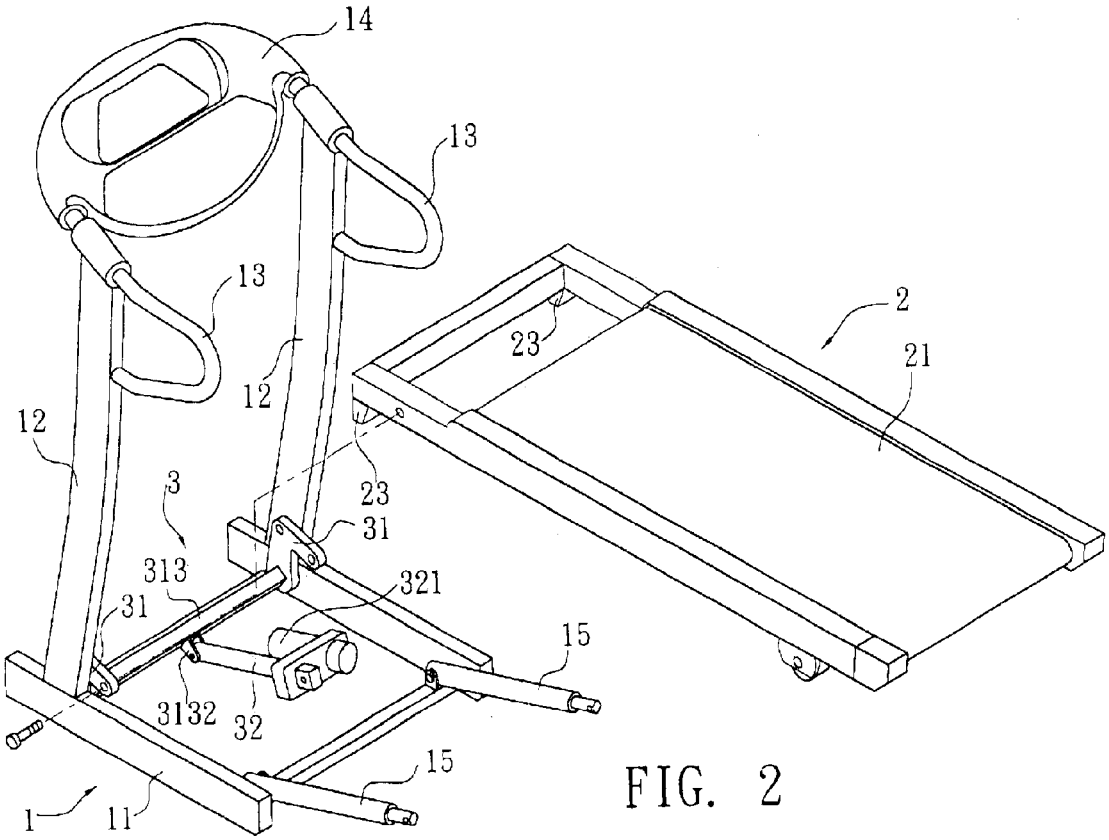
FIG. 2 is a perspective exploded view of the present invention.
Figure 3:
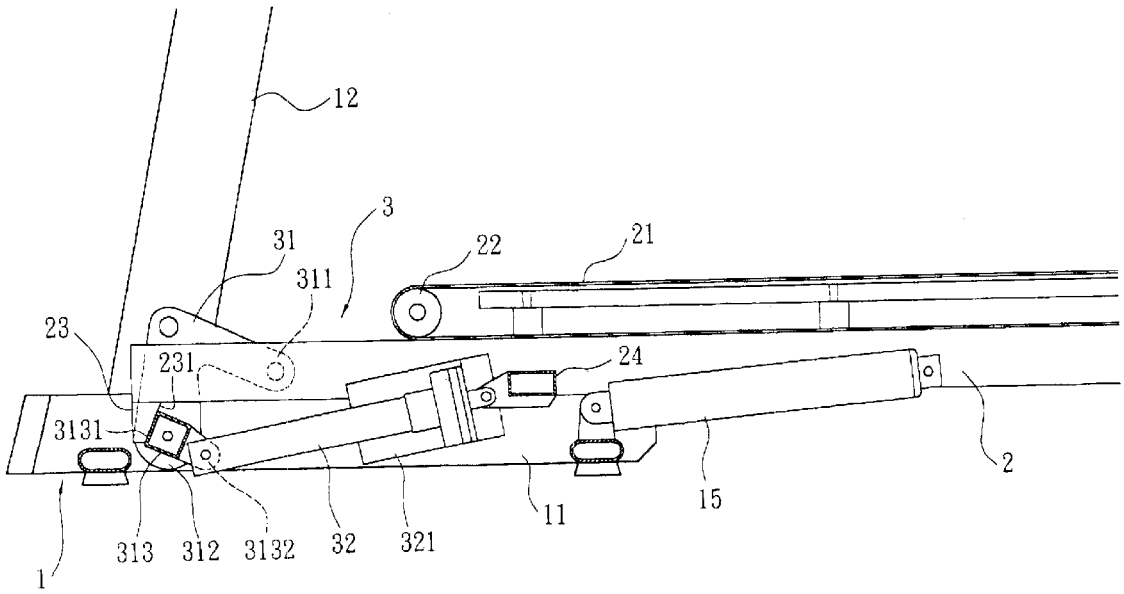
FIG. 3 is a side view of the present invention, in which the tread platform is not ascended/descended.

Please refer to FIGS. 1 to 3. The present invention is related to a gradient adjusting structure of a treadmill including a base seat 1, a tread platform 2 and a gradient adjusting device 3.

The left and right sides of the base seat 1 respectively have two sidebars 11. An upward extending column 12 is disposed at front end of each side bar 11. A handle 13 is disposed at top end of the column 12. A controlling panel 14 is mounted between the two handles 13 for a user to hold when treading. The controlling panel 14 is for the user to control and adjust the treading speed and slope of the tread platform 2. One end of each of two support levers 15 is pivotally connected with rear end of the side bar 11. The other end of the support lever 15 is pivotally connected with one side of the middle section of the tread platform 2.

The front end of the tread platform 2 is mounted between the two columns 12 of the base seat 1. A tread belt 21 is disposed in the tread platform 2. The tread belt 21 is driven by a motor 22 to circularly rotate. The bottom of front end of the tread platform 2 has at least one stop block 23. In this embodiment, two stop blocks 23 are respectively disposed on two sides of the bottom of front end of the tread platform 2. The stop block 23 has a stop face 231 facing rear end of the tread platform 2. The bottom of middle section of the tread platform 2 has a pivot seat 24.

The gradient adjusting device 3 has two symmetrical adjusting members 31 and a telescopic rod 32. Each adjusting member 31 has a first and a second ends 311, 312 containing a certain angle and outward extending. The center of the adjusting member 31 is pivotally connected with inner face of the column 11 near bottom end thereof. The first ends 311 of the adjusting members 31 are respectively pivotally connected with two sides of front end of the tread platform 2. A transverse beam 313 is fixed between the second ends 312 of the adjusting members 31 and positioned under the bottom of front end of the tread platform 2. The transverse beam 313 has an abutting face 3131 corresponding to the stop face 231 of the stop block 23 of the tread platform 2. The other face of the transverse beam 313 opposite to the abutting face 3131 has a pivot seat 3132 pivotally connected with one end of the telescopic rod 32. The other end of the telescopic rod 32 is pivotally connected with the pivot seat 24 of the bottom of the tread platform 2. The telescopic rod 32 is driven by a power source 321 to extend/retract. In this embodiment, the telescopic rod 32 is a worm and the power source 321 is a lifting motor.

Figure 4:
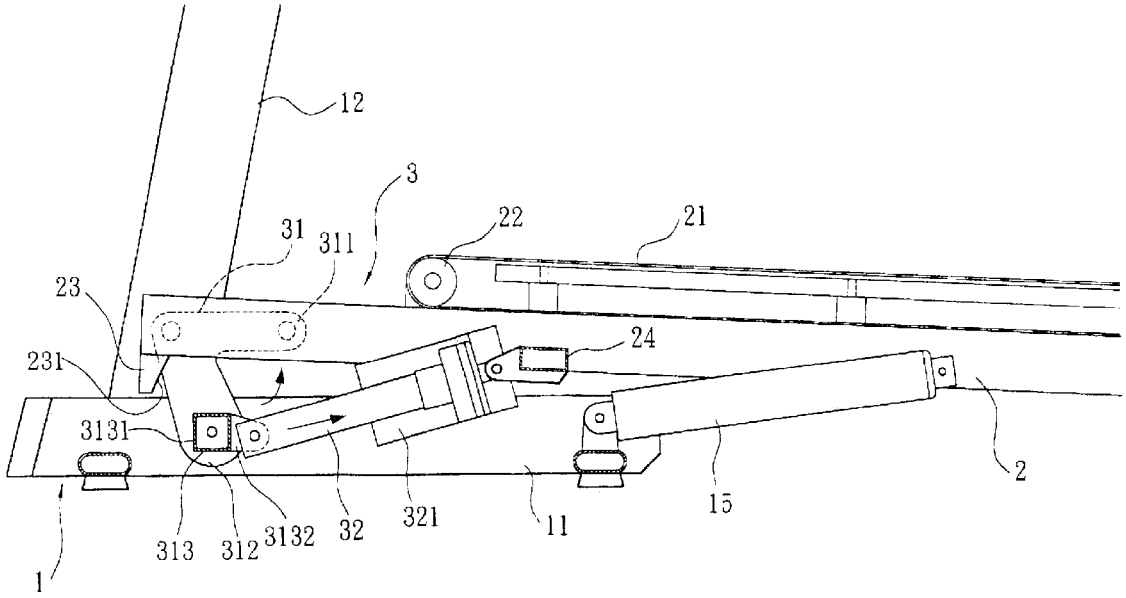
FIG. 4 is a side view of the present invention, in which the tread platform is ascended.

FIGS. 3 and 4 show the gradient adjusting operation of the tread platform of the present invention. The power source 321 controls tile telescopic rod 32 to retract so as to pull the transverse beam 313 of the second ends 312 of the adjusting members 31 to move rearward. The front end of the tread platform 2 is upward lifted about the pivot sections between the adjusting members 31 and the columns 12 of the base seat 1. Accordingly, the slope of the tread platform 2 on the base seat 1 can be adjusted. Reversely, when lowering the tread platform 2, the power source 321 controls the telescopic rod 32 to extend forward so as to push the transverse beam 313 forward. At this time, the front end section 22 of the tread platform 2 is lowered. When the tread platform 2 is lowered to the bottom, the stop faces 231 of the stop blocks 23 of the bottom of front end of the tread platform 2 will abut against the abutting face 3131 of the transverse beam 313 of the adjusting members 31 so as to support the tread platform 2.

Figure 5:
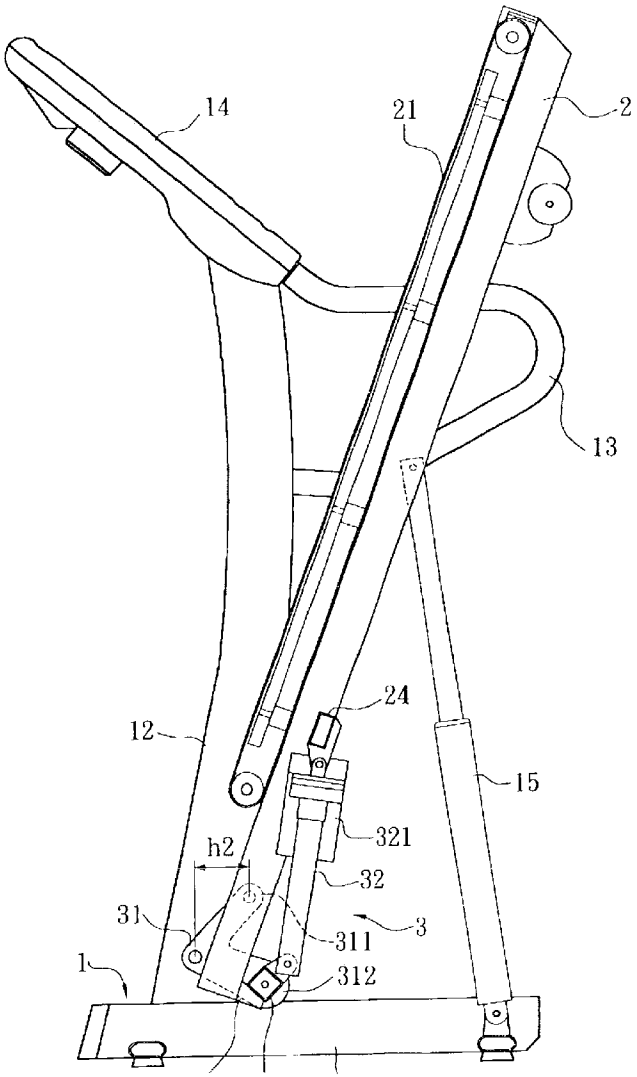
FIG. 5 is a side view of the present invention, in which the tread platform is folded.

FIG. 5 shows the folding operation of the tread platform of the present invention. When folding the treadmill, the rear end of the tread platform 2 is upward folded about the pivot sections between the adjusting members 31 and the columns 12 of the base seat 1 so as to minify the volume of the treadmill and facilitate storage thereof. When the rear end of the tread platform 2 is upward folded, the two support levers 15 of the base seat 1 will be extended along with the tread platform 2 to support the folded tread platform 2.

Figure 6:
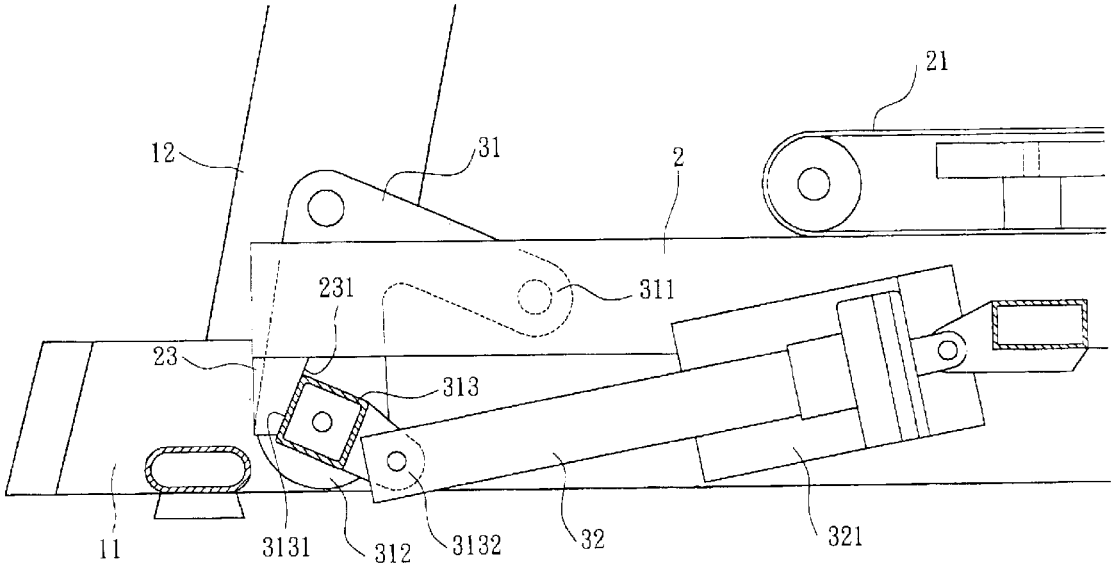
FIG. 6 is a side view of the present invention, in which the stop block of front end of the tread platform abuts against the transverse beam.

When the tread platform 2 is lowered to the bottom, the stop faces 231 of the stop blocks 23 of the bottom of front end of the tread platform 2 will abut against the abutting face 3131 of the transverse beam 313 of the adjusting members 31 so as to support the tread platform 2 as shown in FIG. 6. When the telescopic rod 32 is extended to a longest extent to make the tread platform 2 lowered to the bottom, the weight loaded on the tread platform 2 and the tread force are shared by the transverse beam 23 with the tread platform 2. Accordingly, the bending stress exerted onto the telescopic rod 32 is minimized to prevent the telescopic rod 32 from being worn.

Furthermore, when the rear end of the tread platform 2 is upward folded about the pivot sections between the adjusting members 31 and the columns 12 of the base seat 1, the first ends 311 of the adjusting members 31 pivotally connected with the tread platform 2 are upward swung along with the tread platform 2. Accordingly, the force arm h2 between the pivot sections of the adjusting members 31 pivotally connecting with the columns 12 and the tread platform 2 is shortened. Accordingly, the folded tread platform 2 can be stably supported.

Figure 7:
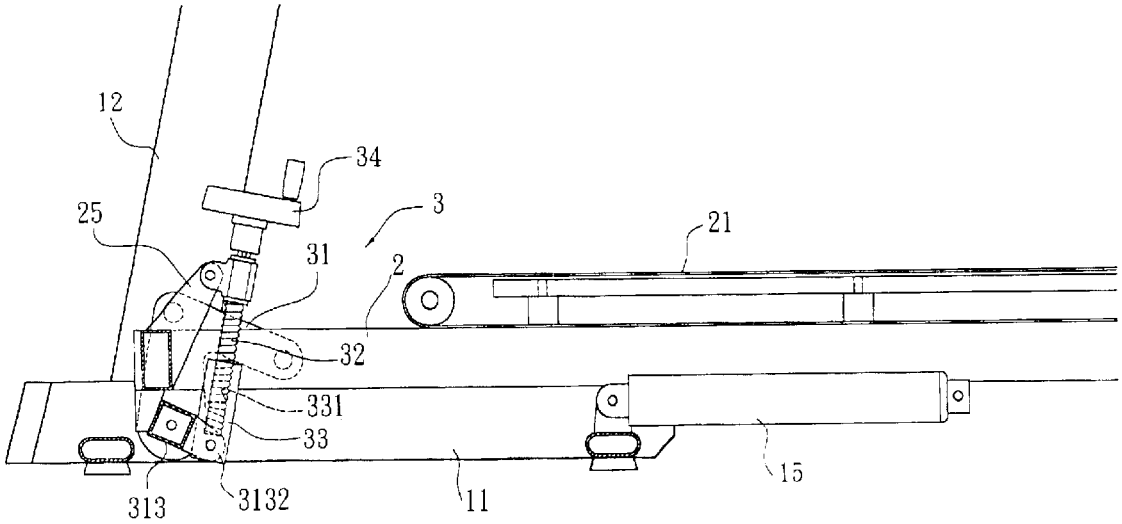
FIG. 7 is a side view of a second embodiment of the present invention, showing a manually operable gradient adjusting structure.
Figure 8:
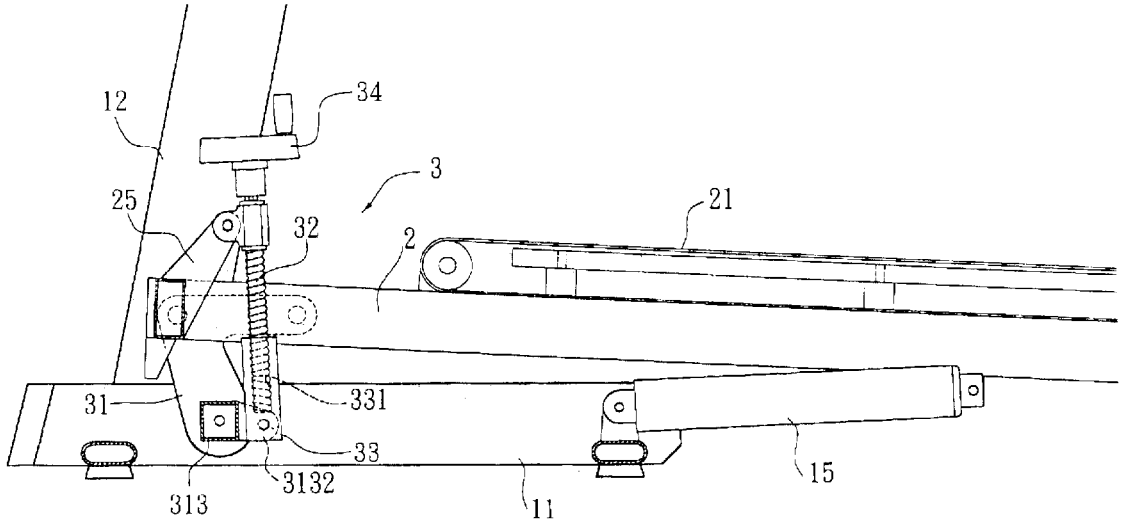
FIG. 8 is a side view of the second embodiment of the present invention, showing the operation of the manually operable gradient adjusting structure.
Figure 9:
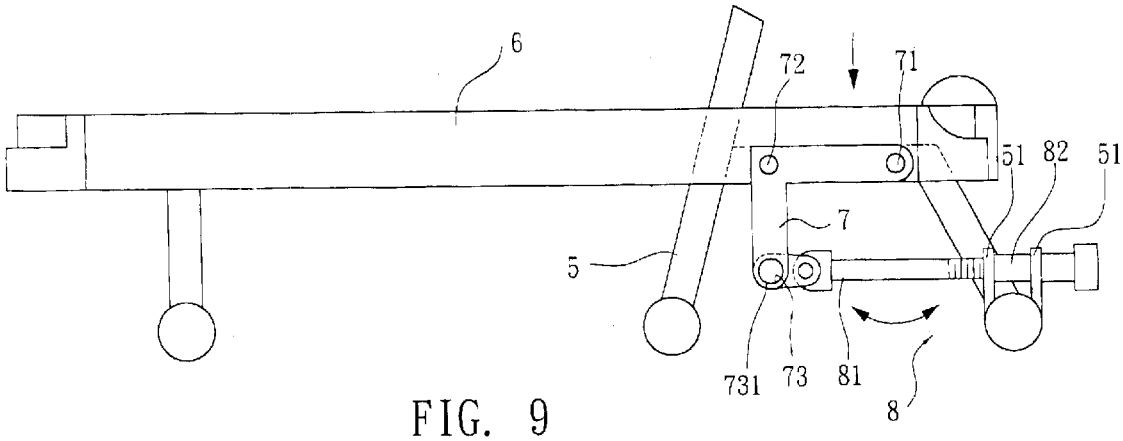
FIG. 9 PRIOR ART
FIG. 9 shows a height adjustment device for tread frame of a conventional treadmill.
Figure 10:
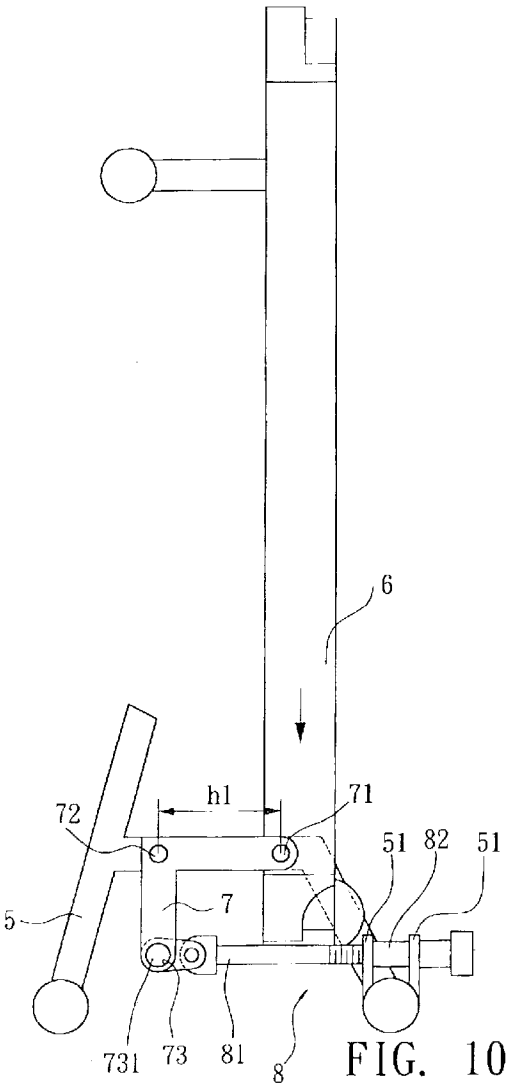
FIG. 10 PRIOR ART
FIG. 10 is a view according to FIG. 9, showing that the tread frame of the conventional treadmill is folded.

In the above embodiment, the telescopic rod 32 is driven to extend/retract by means of electric measure so as to ascend/descend the front end of the tread platform 2. Alternatively, the front end of the tread platform 2 can be manually ascended/descended. As shown in FIGS. 7 and 8, in a second embodiment of the present invention, a seat body 25 is disposed on top face of front end of the tread platform 2. The telescopic rod 32 of the gradient adjusting device 3 is pivotally disposed on the seat body 25. A threaded seat 33 is pivotally disposed on the pivot seat 3132 of the transverse beam 313 of the adjusting members 31. The threaded seat 33 has an inner thread hole 331 in which one end of the telescopic rod 32 is screwed. The other end of the telescopic rod 32 is provided with a rotary wheel 34. By means of rotating the rotary wheel 34, the telescopic rod 32 drives the threaded seat 33 to ascend or descend. Accordingly, the two adjusting members 31 are driven to swing about the pivot sections between the adjusting members 31 and the columns 12. Therefore, the tread platform 2 can be manually operated to ascend or descend.

The above embodiments are only used to illustrate the present invention, not intended to limit the scope thereof. Many modifications of the above embodiments can be made without departing from the spirit of the present invention.

What is claimed is:

1. A treadmill comprising a base seat, a tread platform and a gradient adjusting device wherein:

two sides of the base seat respectively have two upward extending columns, a front end of the tread platform being mounted between the two columns of the base seat, a tread belt being disposed on the tread platform, a bottom of said front end of the tread platform having at least one stop block; and the gradient adjusting device has two symmetrical adjusting members and an telescopic rod, each adjusting member having a first and a second ends containing a certain angle and outward extending, a center of each of the adjusting member is pivotally connected with an inner face of column one or the other of said near bottom end thereof, the first ends of the adjusting members being respectively pivotally connected with two sides of the front end of the tread platform, a transverse beam being fixed between the second ends of the adjusting members and positioned under the bottom of the front end of the tread platform, whereby the stop block of the tread platform can abut against the transverse beam, the adjusting members being driven by the telescopic rod to swing.

2. A treadmill as claimed in claim 1, wherein left and right sides of the base seat respectively have two side bars, the upward extending columns being respectively disposed at front ends of the side bars, two handles being respectively disposed at top ends of the columns, a controlling panel being mounted between the two handles, the tread belt being driven by a motor to circularly rotate, two stop blocks being respectively disposed on two sides of the bottom of the front end of the tread platform, each stop block having a stop face facing a rear end of the tread platform, the bottom of a middle section of the tread platform having a pivot seat, one end of the telescopic rod being pivotally connected with the pivot seat, the transverse beam having an abutting face corresponding to the stop face of the stop block of the tread platform, the other face of the transverse beam opposite to the abutting face having a pivot seat with which the other end of the telescopic rod is pivotally connected.

3. A treadmill as claimed in claim 2, wherein one end of each of two support levers is pivotally connected with a rear end of one of the side bars, the other end of each support lever being pivotally connected with a respective side of the middle section of the tread platform.

4. A treadmill as claimed in claim 1, wherein the telescopic rod is driven by a power source.

5. A treadmill as claimed in claim 4, wherein the telescopic rod is a worm and the power source is a lifting motor.

6. A treadmill as claimed in claim 1, wherein a seat body is disposed on a top face of front end of the tread platform, the telescopic rod of the gradient adjusting device being pivotally disposed on the seat body, a threaded seat being pivotally disposed on one side of the transverse beam of the adjusting members, the threaded seat having all inner thread hole in which one end of the telescopic rod is screwed, the other end of the telescopic rod being provided with a rotary wheel.

* * * * *